US007743622B2

(12) United States Patent
Fischer et al.

(10) Patent No.: US 7,743,622 B2
(45) Date of Patent: Jun. 29, 2010

(54) ICE DISPENSING AND DETECTING APPARATUS

(75) Inventors: Marcus Roland Fischer, Stevensville, MI (US); Amy Lauren Siwek, Dewitt, MI (US); Kevin Michael Chase, Saint Joseph, MI (US); Tony Lee Koenigsknecht, Saint Joseph, MI (US); Randell Lee Jeffery, Stevensville, MI (US); Larry Thomas Bashark, Saint Joseph, MI (US); Jordan Robert Fountain, Saint Joseph, MI (US); Brandon Michael Dawson, Dearborn Heights, MI (US); Ryan Dean McCollum, Redondo Beach, CA (US); Matthew Russel Schwartz, Minneapolis, MN (US)

(73) Assignee: Whirlpool Corporation, Benton Harbor, MI (US)

( * ) Notice: Subject to any disclaimer, the term of this patent is extended or adjusted under 35 U.S.C. 154(b) by 389 days.

(21) Appl. No.: 11/608,474

(22) Filed: Dec. 8, 2006

(65) Prior Publication Data

US 2008/0134709 A1 Jun. 12, 2008

(51) Int. Cl.
*F25C 5/18* (2006.01)

(52) U.S. Cl. ..... 62/344; 221/174; 222/64

(58) Field of Classification Search ..... 62/320, 62/344; 222/64; 221/10, 174
See application file for complete search history.

(56) References Cited

U.S. PATENT DOCUMENTS

| | | | | |
|---|---|---|---|---|
| 2,510,400 | A * | 6/1950 | Hurley | 62/137 |
| 3,075,363 | A | 1/1963 | Conto | |
| 3,437,244 | A | 4/1969 | Alvarez et al. | |
| 3,602,406 | A | 8/1971 | Jacobus et al. | |
| 3,744,679 | A | 7/1973 | Nitschneider et al. | |
| 4,084,725 | A | 4/1978 | Buchser | |
| 4,176,527 | A | 12/1979 | Linstromberg et al. | |
| 4,602,711 | A * | 7/1986 | Wullenwaber | 198/533 |
| 4,627,556 | A | 12/1986 | Brooks | |
| 4,930,685 | A | 6/1990 | Landers | |
| 4,942,979 | A | 7/1990 | Linstromberg et al. | |
| 4,981,237 | A | 1/1991 | Landers | |
| 5,037,004 | A | 8/1991 | Katz et al. | |
| 5,142,878 | A * | 9/1992 | Hida et al. | 62/137 |
| 5,195,651 | A * | 3/1993 | Felde et al. | 221/174 |
| 5,335,810 | A * | 8/1994 | Holloway | 221/10 |
| 5,390,504 | A * | 2/1995 | Hida et al. | 62/137 |
| 5,501,081 | A * | 3/1996 | Mori et al. | 62/135 |
| 5,553,744 | A | 9/1996 | Sawyer, III | |
| 6,607,096 | B2 | 8/2003 | Glass et al. | |
| 6,904,765 | B2 * | 6/2005 | Lee et al. | 62/320 |
| 7,111,473 | B2 * | 9/2006 | Chung et al. | 62/320 |
| 2005/0166627 | A1 | 8/2005 | Son | |
| 2006/0059939 | A1 * | 3/2006 | An et al. | 62/344 |

* cited by examiner

*Primary Examiner*—William E Tapolcai
(74) *Attorney, Agent, or Firm*—Kirk W. Goodwin; McGarry Bair PC

(57) ABSTRACT

The present invention relates to an ice dispenser apparatus having an ice storage bin removably mounted to the refrigerator for receiving and storing ice pieces from an ice maker, a metering device for separating individual ice pieces, and a sensing device for detecting the presence of ice pieces. Actuation of a motor causes the metering device to separate individual ice pieces and the sensing device detects ice pieces before, after, or during dispensing.

14 Claims, 10 Drawing Sheets

ICE DISPENSING AND DETECTING APPARATUS

BACKGROUND OF THE INVENTION

1. Field of the Invention

The invention relates to an ice dispenser for a refrigerator and more particularly to measured dispensing of ice pieces and sensing of dispensed ice pieces.

2. Description of Related Art

Ice dispensing systems for use in a home refrigerator are commonly known. A typical ice dispensing system includes an ice storage bin for receiving and storing ice pieces from an ice maker. The ice storage bin typically has an agitator to prevent the formation of large ice chunks. When a user requests ice, rotation of the agitator also functions to move ice pieces through an opening in the ice storage bin to be dispensed through a chute. The dispensed ice is usually in the form of ice cubes, crushed ice, shaved ice, or crescent-shaped ice. The ice dispensing system may be disposed within the freezer compartment of the refrigerator or may be mounted in a refrigerator closure member or door. U.S. Pat. No. 6,082,130, to Pastryk et al. is an example of a prior art ice dispensing system that is mounted in a refrigerator closure member or door.

One problem with conventional ice dispensing systems is the inconsistency of the ice dispensing. The refrigerator may initially dispense one cube and then suddenly dispense several cubes, which is undesirable for a user. This problem is especially manifested when dispensing crescent-shaped ice pieces. The elongated form of crescent-shaped ice pieces results in a number of orientations of the ice pieces in the storage bin. The different orientations make it difficult to consistently transfer ice pieces from the storage bin to the dispensing chute. Additionally, the orientation of the crescent-shaped ice pieces in the chute can lead to jamming in the chute, in which case ice pieces cannot be dispensed. Several dispensing methods have been explored in the prior art to address this problem.

For example, U.S. Pat. No. 6,607,096, to Glass et al. discloses a volumetric ice dispensing and measuring device for use in a beverage dispensing machine. As illustrated, ice is moved from an ice bin by a paddle through a chute when a door is opened. When passing through the chute, the ice displaces a measuring wheel. A sensor monitors the rotation of a measuring wheel by observing pulses of light broken by teeth of the wheel. One rotation of the wheel correlates to a pre-determined volume of ice to be dispensed. A control system is connected to the sensor and shuts the door to the ice bin when the sensor determines that the correct volume of ice has been dispensed. One disadvantage of this system is that there is no assurance that an accurate quantity of ice is dispensed. Since the sensor only monitors the rotation of the wheel and not the ice, the wheel may not have ice in it, but the sensor would still count a rotation as having dispensed ice. Furthermore, the sensing system comprises an additional moving part in the measuring wheel. Moving parts add complexity to the design and manufacturing of the system and potentially decrease its reliability.

Another ice dispensing apparatus is disclosed in U.S. Pat. No. 3,075,363, to Conto. The design shown in Conto comprises an ice-collecting wheel mounted in a beverage dispensing machine. A motor drives the ice-collecting wheel and as the wheel rotates, each spoke collects a volume of chipped ice. The volume of ice contained in the spoke is then dispensed through an opening. This design is not well suited for the dispensing of cubed ice. The spokes of the wheel can cause the system to become jammed due to variation in the shape of the ice. Additionally, there is no assurance that ice will be dispensed.

Finally, U.S. Pat. No. 4,942,979, to Linstomberg et al. discloses an ice dispensing apparatus that utilizes a helical structure to dispense discrete quantities of ice pieces. The helical structure separates the ice pieces and is rotated for a period of time to dispense a pre-selected volume of ice pieces. One disadvantage of this invention is in the amount of space required in the ice dispenser to house the helical structure and driving mechanism. Additionally, there is no assurance that an accurate quantity of ice is dispensed.

As can be seen, the above mentioned patent references lack an ability to detect whether or not ice has in fact been dispensed. Although the designs seek to separate and dispense a predetermined quantity of ice, there is no assurance that a user will obtain the desired quantity. Ice chunks in the storage bin as well as the orientation of ice pieces could prevent ice from being dispensed in the desired quantity. Therefore, an improvement over the prior art would be to detect whether or not an ice piece has been dispensed and to count the ice pieces as they are dispensed.

Another disadvantage of the prior art ice dispensing systems is in the metering device. Systems that utilize a sorting wheel or helical structure can become jammed due to ice chunks and the various orientations of the ice pieces. Therefore, an improvement over the prior art would be a metering device that is less likely to become jammed during operation.

SUMMARY OF THE INVENTION

Accordingly, the present invention is directed to an ice dispenser for a refrigerator that improves the dispensing of a measured amount of ice pieces.

One embodiment of the invention is an ice dispenser apparatus having an ice storage bin removably mounted to the refrigerator for receiving and storing ice pieces from an ice maker, a metering device for separating individual ice pieces, and a sensing device for detecting the presence of ice pieces. Actuation of a motor causes the metering device to separate individual ice pieces and the sensing device detects ice pieces before, after, or during dispensing.

The metering device could comprise a cylindrical hub having an opening at the center to accommodate a shaft or an agitator and a round disc surrounding the hub with at least one opening along the perimeter. In the preferred embodiment of the invention, the metering device has two openings along the perimeter and the surfaces adjacent to the openings are sloped downwardly towards the openings.

The sensing device may comprise one or more optical sensors, capacitive sensors, vibration sensors, ultrasonic sensors, or weight sensors.

Another embodiment of the invention is a refrigerator having an ice storage bin removably mounted to the refrigerator for receiving and storing ice pieces from an ice maker, a metering device for separating individual ice pieces, and a sensing device for detecting the presence of ice pieces. Actuation of a motor causes the metering device to separate individual ice pieces and the sensing device detects ice pieces before, after, or during dispensing. Additionally, the refrigerator could have a receptacle for crushing ice pieces, an agitator operably connected to a motor and at least one dispensing chute through which individual ice pieces are dispensed.

Another embodiment of the invention further comprises a second receptacle for shaving ice pieces and at least one of the receptacles leads to a metering device.

The invention further includes a method of dispensing individual ice pieces including the steps of separating individual ice pieces, dispensing individual ice pieces through a chute, detecting ice pieces, and stopping the dispensing of ice pieces when the ice pieces dispensed reaches the selected amount.

The step of detecting ice pieces may include counting a number of ice pieces. The number of ice pieces may be counted using an optical sensor by counting the number of times a beam of light is broken.

In another embodiment, the number of ice pieces may be counted using a vibration sensor by measuring the vibration of the sensor when contacted by dispensed ice pieces.

In another embodiment, the number of ice pieces may be counted using a capacitive sensor by measuring the change in capacitance as dispensed ice pieces pass by the sensors.

In another embodiment, the number of ice pieces may be counted using a weight sensor by measuring a change in pressure when ice pieces are dispensed.

Alternatively, the step of detecting ice pieces may include detecting a level of ice pieces dispensed.

The level of ice pieces may be detected by using an ultrasonic sensor by emitting ultrasonic waves and calculating the time between sending a wave and receiving a reflected wave.

The invention further includes a method of detecting partial ice pieces in a refrigerator having an ice dispensing system including the steps of sampling an agitator motor current, comparing the current sample to a preset threshold current value, and incrementing a counter if the current sample exceeds the threshold current value. The partial ice pieces may be in the form of crushed ice pieces, shaved ice pieces, or of various other forms. The method of detecting partial ice pieces may further include disregarding current samples during agitator motor startup and disregarding current samples for a preset period of time following the incrementing of the counter.

DESCRIPTION OF THE PREFERRED EMBODIMENTS

Figure 1:
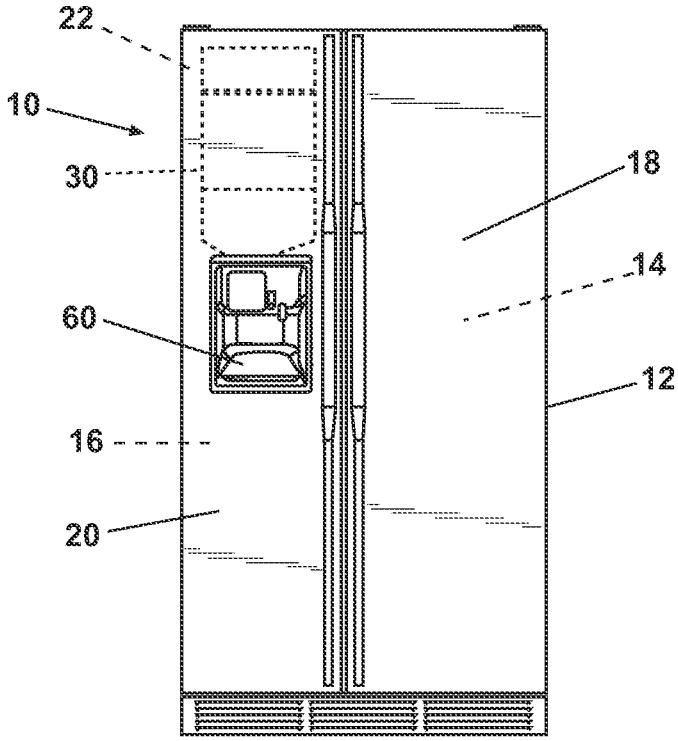
FIG. 1 is a front view of a refrigerator having an ice dispensing system embodying the present invention.
Figure 2:
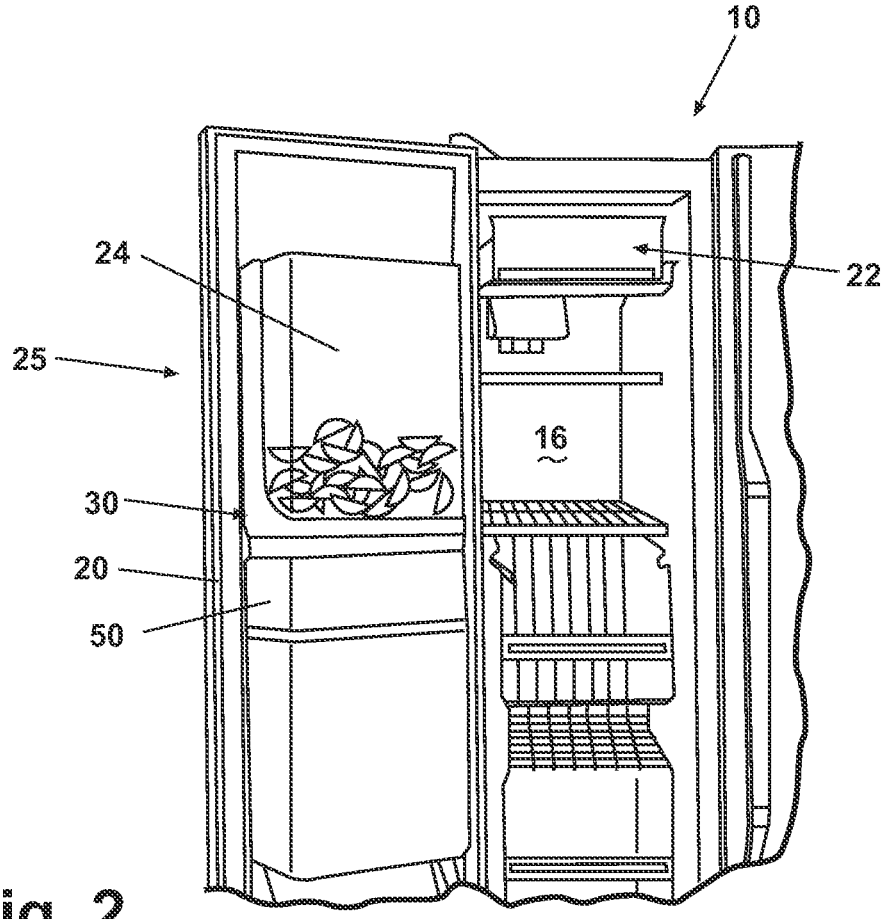
FIG. 2 is a fragmentary perspective view generally illustrating the ice dispensing system within the freezer compartment of the refrigerator.

A refrigerator having an ice dispenser will now be described in detail with initial reference to the illustrative embodiment of the invention as shown in FIGS. 1 and 2. A refrigerator 10 is provided with a cabinet 12 forming a fresh food compartment 14 having an access opening and a freezer compartment 16 also having an access opening. A fresh food door 18 and a freezer door 20 are hingedly mounted to the cabinet 12 to close the access openings.

An ice making assembly 22 may be provided within the freezer compartment 16. The ice making assembly 22 is a conventional ice making apparatus which forms crescent-shaped, cubed, or other shapes of ice pieces. An ice dispensing system 30 is provided within an ice bin assembly 25, located below the ice making assembly 22 to receive ice pieces. In the preferred embodiment, the ice dispensing system 30 is mounted to the freezer door 20. Alternatively, the ice dispensing system 30 may be disposed within the freezer compartment 16 below the ice making assembly 22. An ice service area 60 is provided external to the freezer compartment to service ice requests from a user. In operation, the ice making assembly 22 forms ice pieces which are transferred to the ice dispensing system 30. When a user requests ice pieces via the ice service area 60, the ice dispensing system 30 releases ice pieces.

Figure 3:
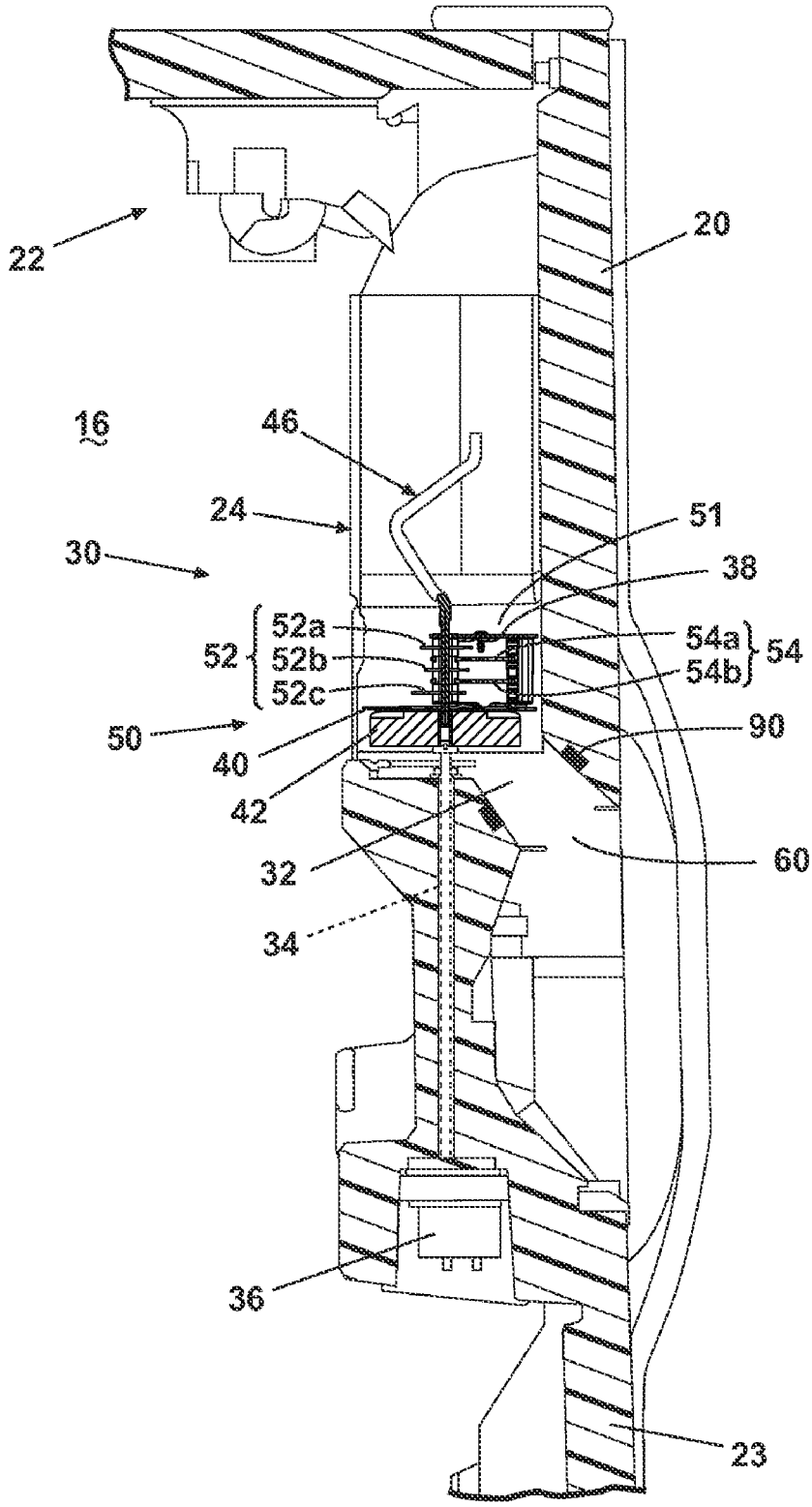
FIG. 3 is a fragmentary, side sectional view of a first embodiment of ice dispensing system of the present invention.

The ice dispensing system 30 of the present invention is further explained with reference to FIGS. 2 and 3. The ice dispensing system generally comprises an ice storage bin 24 for receiving and storing ice pieces from the ice making assembly 22, an ice crushing system 50 for selectively dispensing crushed ice pieces, a metering device 42 for separating individual ice pieces, an ice dispensing chute 32 for releasing ice pieces to the ice service area 60, and a sensing device 90 for detecting ice pieces. Each of these subsystems will be explained in detail in the following sections.

The ice storage bin 24 may be removably mounted to the freezer door 20 or removably mounted within the freezer compartment 16. In the preferred embodiment, an agitator 46 extends into the ice storage bin 24 for separating ice pieces. The agitator may be horizontally or vertically disposed within the ice storage bin 24, as one of skill in the art is aware. The agitator 46 may be in the form of an auger, or shaker, or other rotatable mechanism for moving the ice pieces to aid in the prevention of the formation of large ice chunks. In the present invention, the agitator 46 is operably connected to a shaft 34 and motor 36. Upon actuation of the motor 36, the agitator 46 rotates within the ice storage bin 24 and displaces ice pieces. Ice pieces are thereby transferred to the ice crushing system 50 via an opening in a top blade cover 38. The top blade cover 38 is provided above the ice crushing system 50 to separate the stored ice pieces from the ice crushing system 50. Alternatively, the agitator 46 is a shaker that is operably connected to a motor 36. Upon actuation of the motor 35, the agitator causes movement of the ice storage bin 24 thereby displacing ice pieces.

In the preferred embodiment, the ice crushing system 50 comprises at least one fixed ice crusher blade 52, at least two sets of rotating ice crusher blades 54, an ice crushing housing 51, and a bottom blade cover 40. The fixed ice crusher blades 52 are preferably mounted to the inner wall of the ice crushing housing 51, extending inwardly towards the shaft 34 and having one side formed as a cutting edge. The opposite end of the fixed ice crusher blades 52 may be mounted coterminously with the shaft 34 such that when the shaft 34 rotates, the fixed ice crusher blades 52 do not rotate. The rotating ice crushing blades 54 preferably have one side formed as a cutting edge and can be rotatably mounted to the shaft 34 parallel to but vertically offset from the fixed ice crusher blades 52 to avoid interference. The rotating ice crusher blades 54 extend outwardly towards the inner wall of the ice crushing housing 51. The cutting edge of the fixed ice crusher blades 52 are oriented in a direction opposite to the cutting edge of the rotating ice crushing blades 54, thereby allowing selective ice crushing. The ice crushing housing 51 also typically comprises a cylinder with an opening at the top and bottom and encloses the ice crushing system 50. The shaft 34 extends upwardly through the ice crushing housing 51.

In one embodiment of the invention, the ice crushing system 50 comprises two fixed ice crusher blades 52*a* and 52*b* and three sets of rotating ice crusher blades 54*a*, 54*b*, and 54*c*. In a second embodiment, the ice crushing system 50 comprises one fixed ice crusher blade 52*a* and two sets of rotating ice crusher blades, 54*a* and 54*b*. Using the first configuration, the performance, as measured in output of ice pieces per minute, is higher but the ice crushing system 50 typically occupies a greater amount of space in the bottom ice bin member 28. Using the second configuration, the performance is lower but the ice crushing system 50 typically occupies a smaller space in the bottom ice bin member 28. Other combinations of fixed ice crusher blades 52 and rotating ice crusher blades 54 are possible without altering the function of the ice crushing system 50.

When crushed ice pieces are requested by a user, the motor 36 is actuated and the shaft 34 rotates, thereby moving the rotating ice crusher blades 54. The cutting edge of the rotating ice crusher blades 54 rotates in a direction towards the cutting edge of the fixed ice crusher blades 54. Accordingly, the ice pieces are moved and crushed between the two sets of blades and crushed ice is dispensed.

When uncrushed ice pieces are requested by a user, the motor 36 is actuated and the shaft 34 rotates in the reverse direction, thereby moving the rotating ice crusher blades 54 in the reverse direction. Thus, the cutting edge of the rotating ice crusher blades 54 rotates in a direction away from the cutting edge of the fixed ice crusher blades 54. Accordingly, the ice pieces are not crushed between the two sets of blades and uncrushed ice is dispensed.

The metering device 42 generally comprises a cylindrical hub with an opening in the center to accommodate a shaft. In the preferred embodiment, there is a round disc surrounding the hub with at least one opening along the perimeter, wherein ice pieces are separated after passing through the ice crushing system 50. After ice pieces are individually separated by the metering device 42, the ice pieces are released to the ice service area 60 via the ice dispensing chute 32. In one embodiment of the invention, the sensing device 90 is disposed within the foam material 23 on opposite sides of the ice dispensing chute 32. The sensing device 90 detects whether or not an ice piece has been released. The output of the sensing device 90 is connected to a control system that counts the number of ice pieces dispensed. The ice dispensing system 30 continues to dispense ice pieces until the desired number of pieces is dispensed. Thus, the sensing device 90 is more likely to ensure that the correct number of ice pieces is dispensed.

Figure 4:
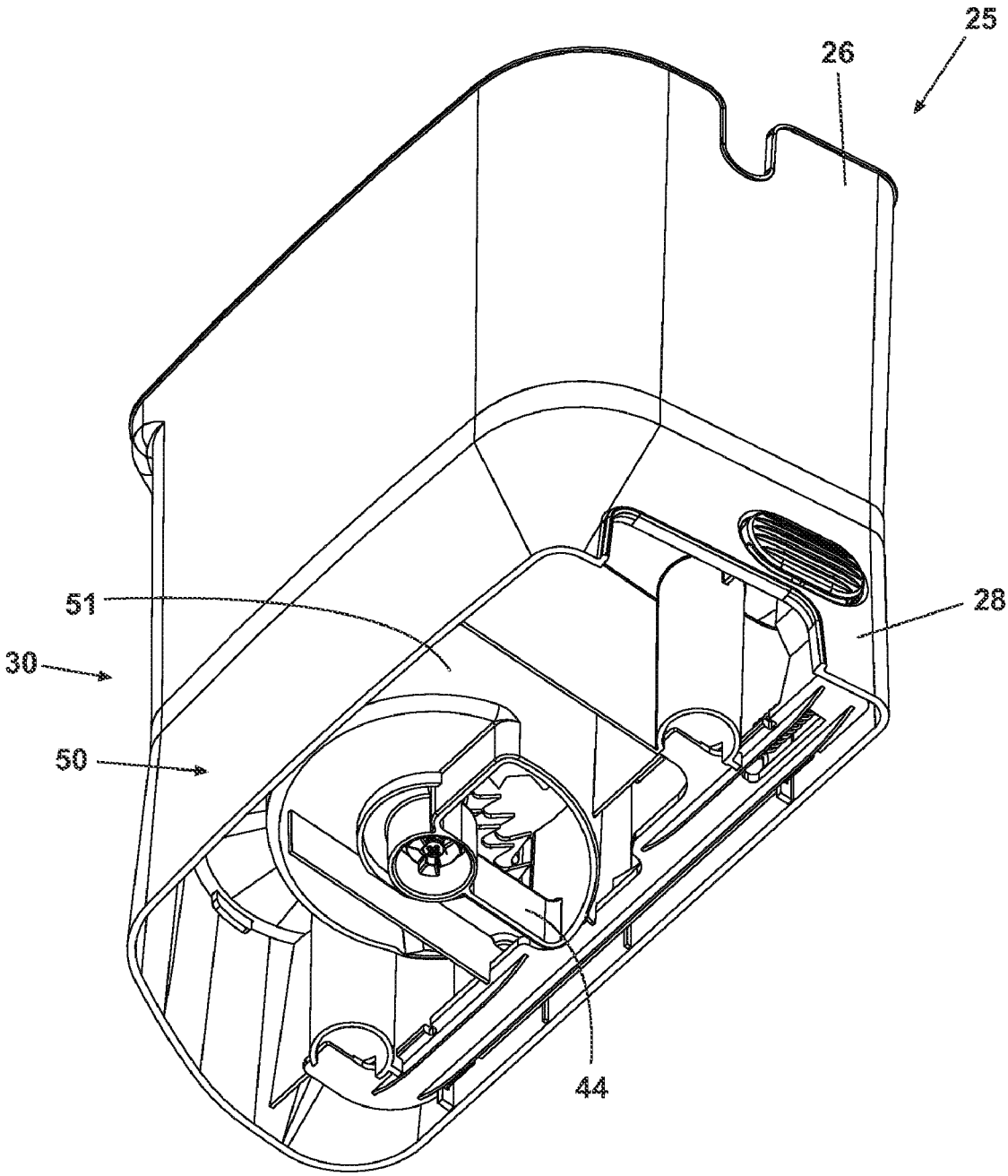
FIG. 4 is an enlarged, perspective view of the bottom of the ice storage bin of the ice dispensing system.

FIG. 4 shows the ice bin assembly 25 comprising an upper ice bin member 26 and a lower ice bin member 28. The upper ice bin member 26 may be removably mounted to the lower ice bin member 28. As shown, the ice dispensing system 30, including the ice crushing system 50 and the ice crushing housing 51, is disposed within the lower ice bin member 28. Ice is released from the ice dispensing system 30 to the ice dispensing chute 32 via an outlet opening 44. The outlet opening 44 may be on the side or bottom of the ice crushing housing 51.

Figure 5:
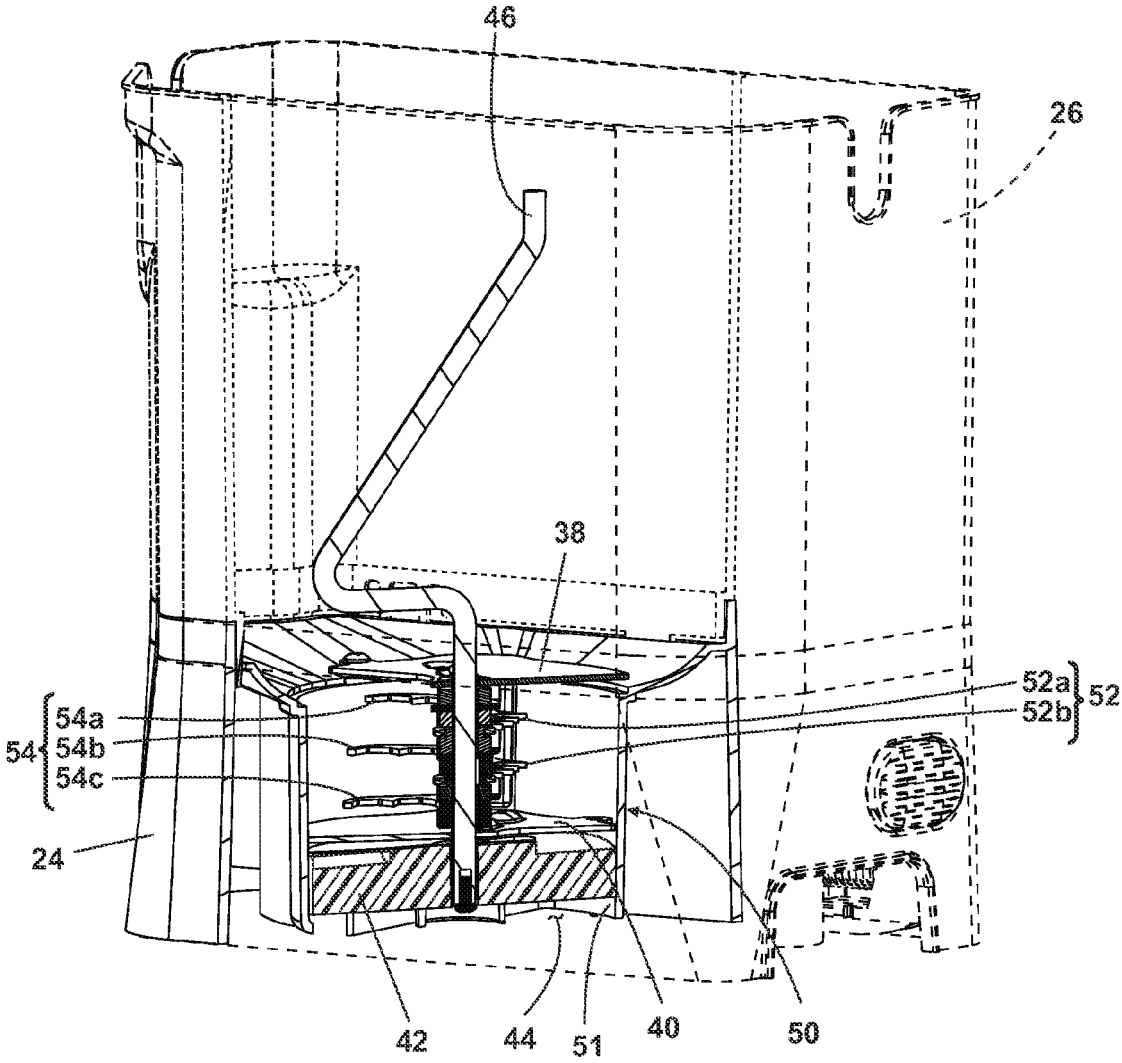
FIG. 5 is a schematic view illustrating an ice storage bin and ice dispensing system according to a first embodiment of the present invention.
Figure 6:
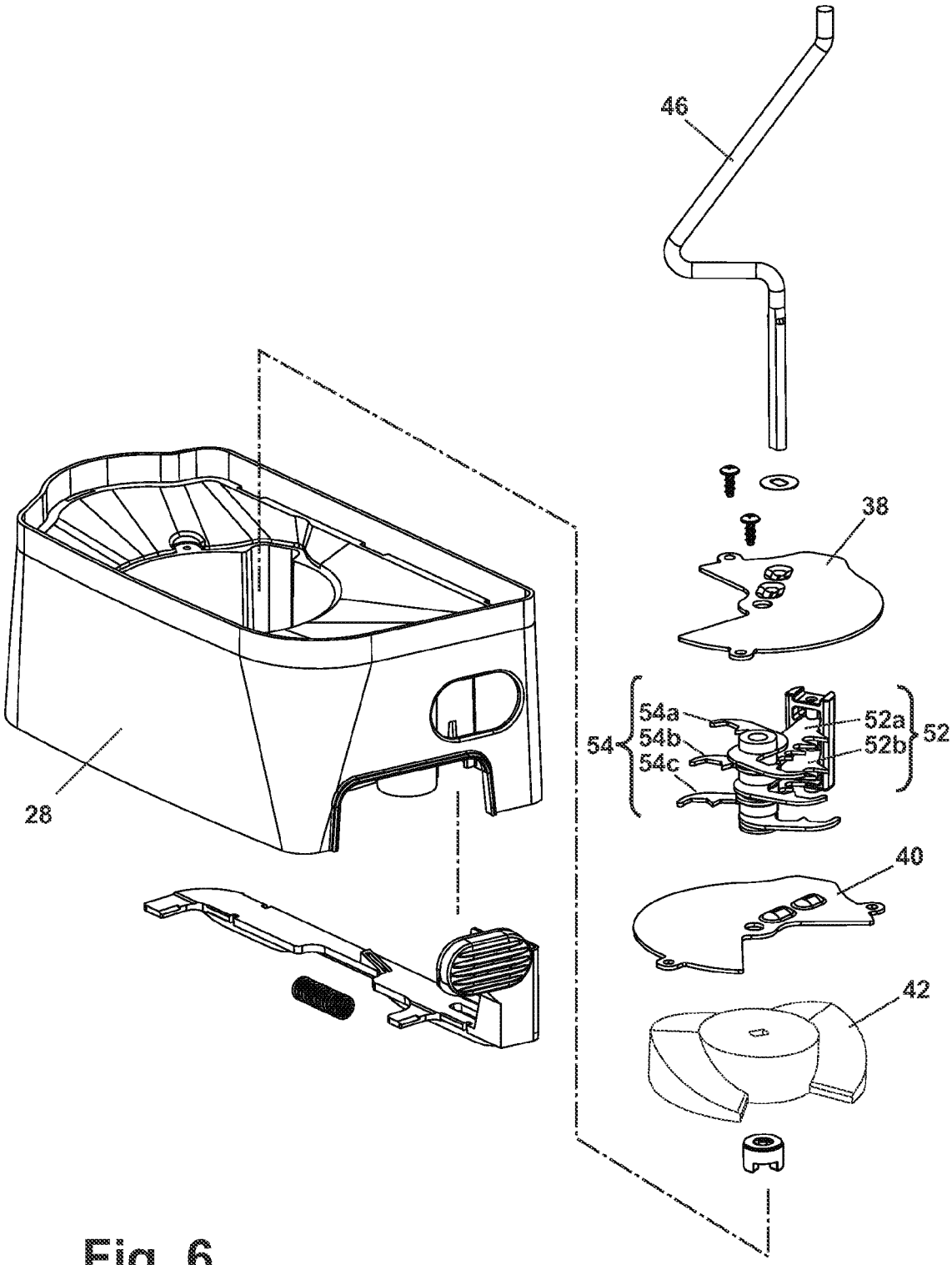
FIG. 6 is an exploded view illustrating the ice dispensing system according to a first embodiment of the present invention.
Figure 7:
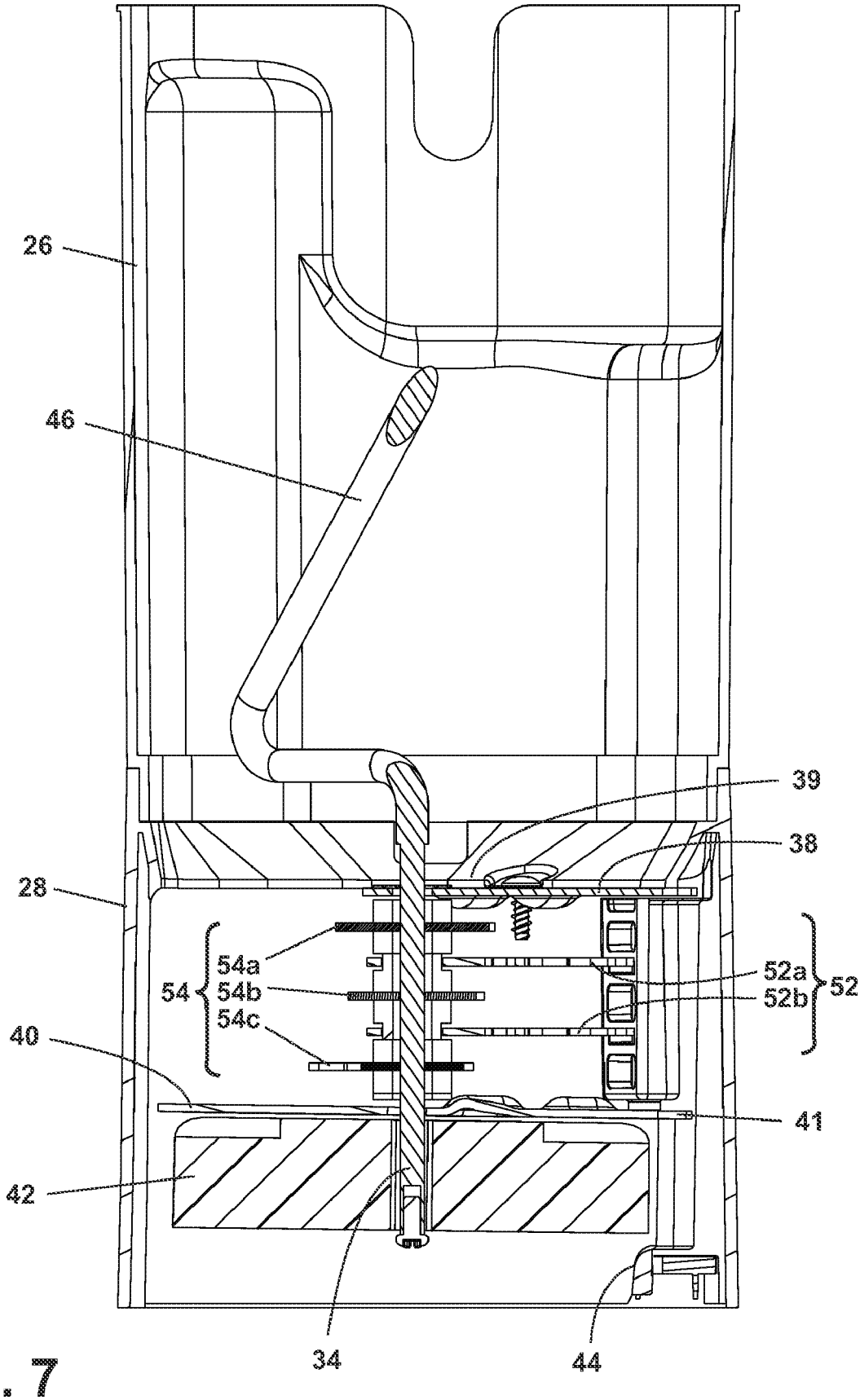
FIG. 7 is a cross-sectional view illustrating an ice storage bin and ice dispensing system according to a first embodiment of the present invention.

FIG. 5 in combination with FIGS. 6 and 7 illustrate the ice dispensing system 30 in greater detail. In the preferred embodiment, the ice crushing system 50 is provided between the top blade cover 38 and the bottom blade cover 40. The metering device is provided below the bottom blade cover 42. While the preferred embodiment of the present invention shows the above stated configuration, it can be readily understood that the order of the components could be changed without altering the function of the invention. For example, the metering device 42 could be provided above the ice crushing system 50 and top blade cover 38 and still achieve the desired result.

As mentioned above, the ice dispensing system 30 may comprise a fixed top blade cover 38 mounted generally in the center of the bottom ice bin member 26. The top blade cover 38 has an opening generally in the center to accommodate the shaft 34 and has at least one opening 39 along the perimeter through which ice pieces may pass. The surface of the bottom ice bin member 26 may be sloped downwardly towards the top blade cover 38 to allow ice pieces to move easily towards the top blade cover opening 39.

The ice dispensing system 30 may further comprise a fixed bottom blade cover 40 mounted generally in the center of the bottom ice bin member 26. The bottom blade cover 38 has an opening in the center to accommodate the shaft 34 and has at least one opening 41 along the perimeter, through which ice pieces may pass. The bottom blade cover opening 41 can be offset from the top blade cover opening 39 so as to prevent overlap of the two openings. As a result, ice pieces may not fall directly from the ice storage bin 24 to the ice dispensing chute 32.

Figure 8:
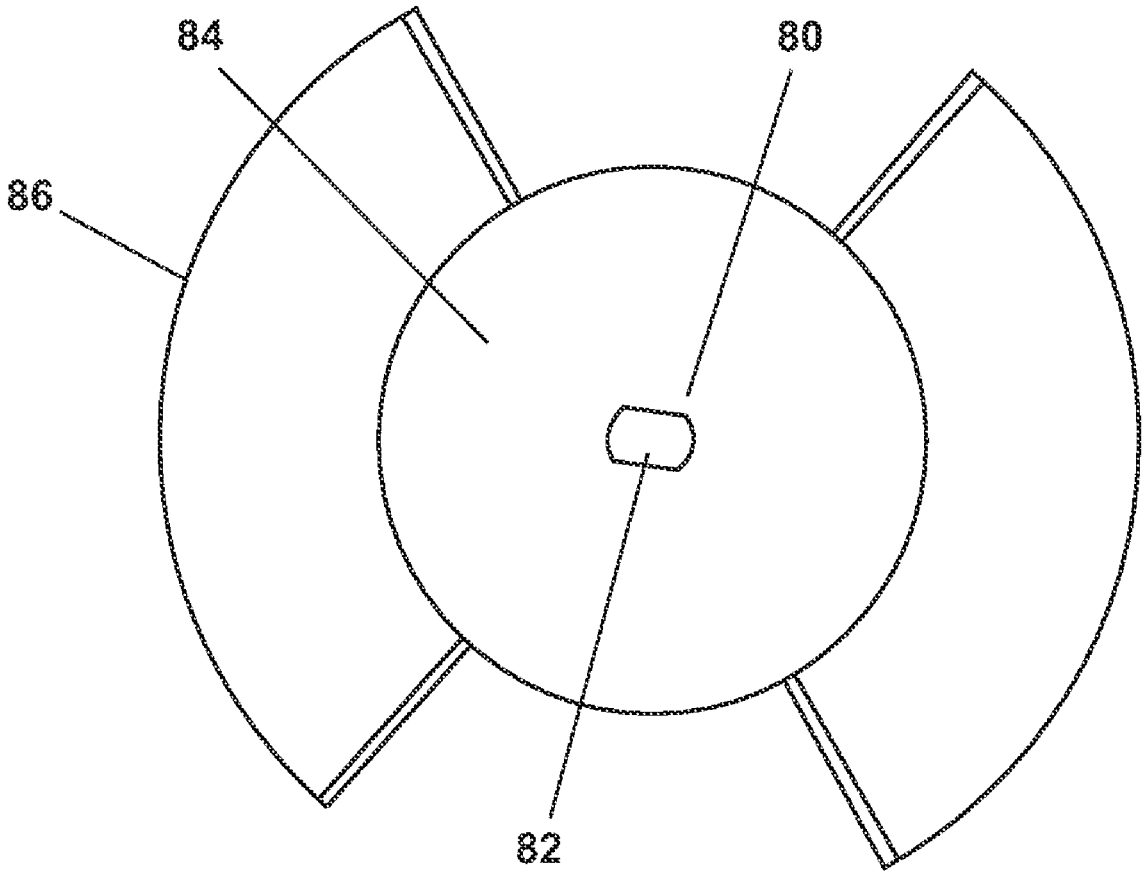
FIG. 8 is a top view illustrating an embodiment of the metering device of the present invention.

The ice dispensing system 30 further comprises a metering device 42, shown in detail in FIG. 8. As previously stated, the metering device may comprise a cylindrical hub 80 with an opening 82 in the center to accommodate the shaft 34. Surrounding the cylindrical hub 80 is an outer cylinder 84. The outer cylinder 84 may be sloped downwardly from the outer edge of the cylindrical hub 80 towards the outer edge of the outer cylinder 84 to allow ice pieces to move easily into the opening. Surrounding the outer cylinder 84 may also be an outer disc 86 having at least one opening along the perimeter. Each opening being designed to accommodate an individual ice piece. The ice pieces may be crescent-shaped, cubed, cylindrical, or of various other shapes. The surfaces adjacent to the openings are sloped gradually downward towards the opening to allow ice pieces to move more easily into the opening and to lessen the likelihood of jamming and ice breakage. In the preferred embodiment, the metering device 42 comprises two openings for ice pieces although, as one of skill in the art will recognize, any number of openings is possible. The edges of the openings may be rounded to decrease the possibility of broken or jammed ice pieces.

There are several advantages to using the stated geometry for the metering device 42. Using more than one opening allows for an increased rate of dispensing. The sloped surfaces leading to the openings make it easy for ice pieces to flow into the openings of the metering device 42 while minimizing the possibility of jamming the system or breaking the ice pieces. Additionally, the openings can be specifically sized to accommodate a single crescent-shaped ice piece. Thus, the metering device 42 is configured to more likely ensure that at most one ice piece will be dispensed at a time.

As illustrated from FIGS. 5, 6 and 7, when operated, the agitator 46 is rotated by the shaft 34 to move ice pieces into the dispensing system 30 via a top blade cover opening 39 in the top blade cover 38. Concomitantly, the rotating ice crusher blades 54 rotate in the same direction as the agitator 46. If the agitator 46 is rotating in one direction, the ice pieces will be crushed between the rotating ice crusher blades 54 and fixed ice crusher blades 52. If the agitator is rotating in the opposite direction, the ice pieces will not be crushed. After passing through the ice crushing housing 51, the ice pieces exit the ice crushing system 50 via a bottom blade cover opening 41 in the bottom blade cover 40. The ice pieces are then separated by the metering device 42, which rotates according to the shaft 34. Ice pieces exit the ice dispensing system 30 one ice piece at a time through an outlet opening 44, which may be on a side or the bottom of the ice crushing housing 51.

After the ice pieces are released from the ice dispensing system 30, the ice pieces pass through the ice dispensing chute 32. In one embodiment, as previously shown in FIG. 3 a sensing device 90 is disposed within the foam material 23 on opposite sides of the ice dispensing chute 32 and detects whether or not an ice piece is being dispensed. Thus, the dispensing system 30 can continue to dispense ice pieces until the desired number of ice pieces is dispensed, as requested by a user.

Referring again to FIG. 3, the sensing device 90 may be at least two capacitive sensors 90*a* and 90*b* embedded in the foam material 23 on opposite sides of the ice dispensing chute 32. The sensing device 90 may comprise two capacitive plates or strips positioned on opposite sides of the ice dispensing chute 32. The two plates or strips may be embedded in the foam material 23 as previously described or may be mounted on the inner or outer wall of the ice dispensing chute 32. Alternatively, the sensing device 90 may comprise one capacitive plate or strip mounted to the ice dispensing chute 32 and referenced to ground. The plate or strip may be embedded in the foam material 23 or may be mounted on the inner or outer wall of the ice dispensing chute 32, or mounted to the housing of the ice service area 60.

In operation, when an ice piece passes through the ice dispensing chute 32, the presence of the ice piece will change the dielectric constant between the capacitive plates or between the capacitive plate and ground. The change in dielectric constant results in a change in capacitance that is detectable to a control system. Thus, the number of ice pieces dispensed can be counted by measuring the change in capacitance when an ice piece passes through the ice dispensing chute 32. The control system may be configured to a means to compensate for temperature changes or warping of the ice dispensing chute 32, and dirt, dust, and other foreign materials that could hinder or interfere with the performance of the capacitive sensors 90*a* and 90*b*.

Figure 9B:
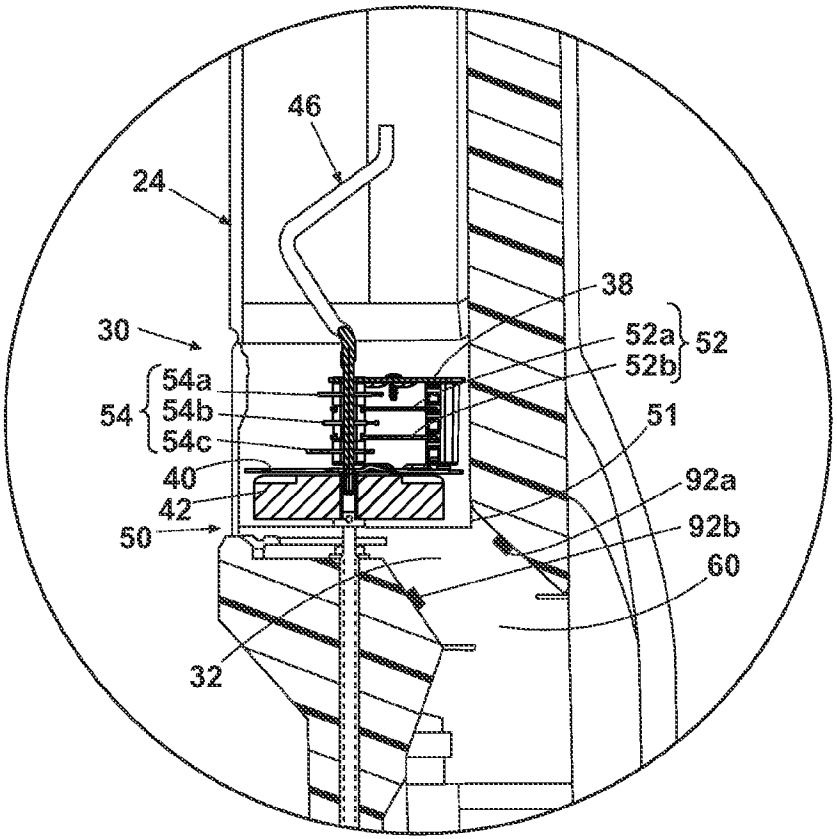
FIG. 9*b* is a fragmentary, side sectional view of the ice dispensing system illustrating an embodiment of a sensing system of the present invention.
Figure 9A:
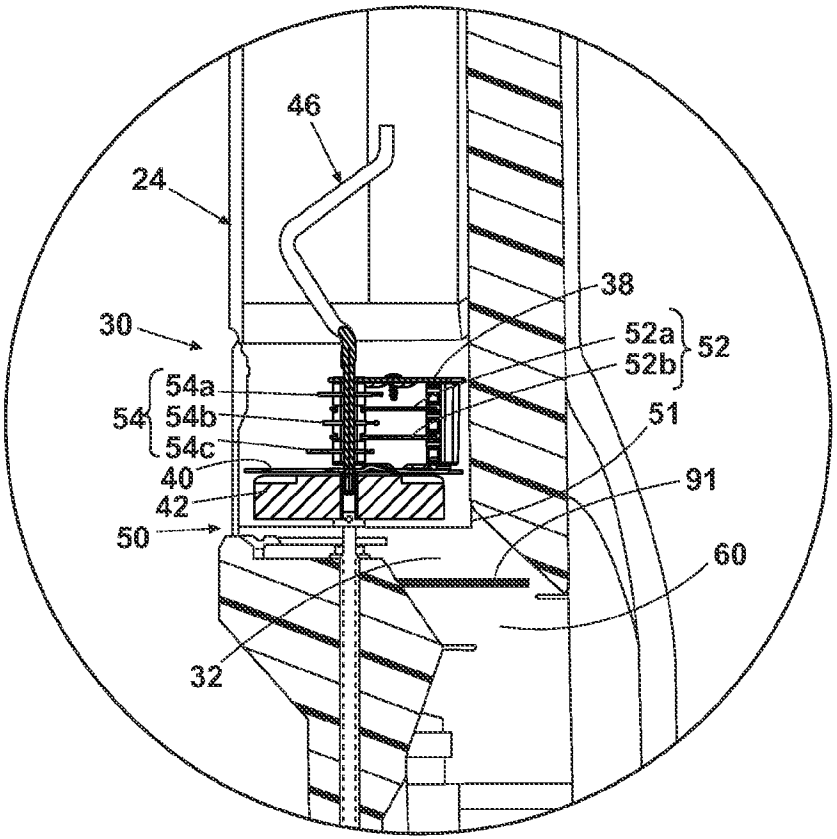
FIG. 9*a* is a fragmentary, side sectional view of the ice dispensing system illustrating an embodiment of a sensing system of the present invention.

Referring to FIG. 9*a*, the sensing device 90 may be at least one vibration sensor 91. In this embodiment, the vibration sensor 91 is a polyvinylidene flouride (PVDF) piezo-film sensor, comprising a narrow, flexible beam. One advantage of using PVDF piezo-film sensors is their flexibility and size, which minimizes the possibility of ice pieces becoming jammed in the ice dispensing chute 32. The vibration sensor 91 projects into the ice dispensing chute 32 with one end mounted to the inner wall of the ice dispensing chute 32. To provide sufficient area coverage to intercept a dispensed ice cube in the ice dispensing chute 32, more than one vibration sensor 91 may be used. The additional vibration sensors 91 can be positioned within the ice dispensing chute 32 parallel to but offset horizontally from the first vibration sensor 91. In the preferred embodiment, two vibration sensors 91 are positioned within the ice dispensing chute 32.

In operation, when the vibration sensor 91 is contacted and displaced by dispensed ice pieces, the sensor measures the mechanical strain. The vibration sensor 91 then converts the mechanical strain measurement from each hit into a voltage, which may be applied to a circuit comprising one or more resistors, diodes, capacitors, or other electrical components. For the preferred embodiment having two vibration sensors, the output of said circuit is a unidirectional positive voltage of convenient magnitude for analog-to-digital sampling and microprocessor analysis as is known to those skilled in the art. Thus, the control system samples the output of the circuit and may be configured to discriminate between displacement by a dispensed ice piece from background mechanical vibration noise or electrical noise. The control system can thereby determine if a dispensed ice piece has displaced the vibration sensor 91.

Referring to FIG. 9*b*, the sensing device 90 may comprise at least two optical sensors 92. The sensors may include a light emitter 92*a* and a receiver 92*b*. The emitter 92*a* may be mounted on one side of the ice dispensing chute 32 while the receiver 92*b* may be mounted to the opposite side of the ice dispensing chute 32. The emitter 92*a* may be a printed circuit board having an IR photo diode which emits an IR light. The output of the receiver 92*b* may be a printed circuit board having a phototransistor. The receiver is operably connected to a control system that controls the operation of the ice dispensing system 30.

In operation, the emitter 92*a* generates a beam of IR light. The beam of light is directed towards the receiver 92*b* such that the beam passes through the path of an ice piece as it is being dispensed through the ice dispensing chute 32. In the absence of dispensed ice pieces, the beam of IR light extends from the emitter 92*a* to the receiver 92*b*. When an ice piece is dispensed, the ice piece will interrupt the beam of IR light. Thus, if the receiver 92*b* senses IR light from the emitter when an ice piece should be dispensed, this indicates that the ice dispensing system 30 has erroneously not dispensed an ice piece. The control system can then send a signal to dispense another piece of ice to compensate for the ice piece that was not dispensed.

In an alternative embodiment, the sensing device 90 may comprise one optical sensor 92. The optical sensor may be a retroreflective sensor, comprising an emitter portion and receiver portion. The emitter portion is positioned adjacent to the receiver portion and both are mounted on one side of the ice dispensing chute 32. The retroreflective sensor is operably connected to a control system that controls the operation of the ice dispensing system 30. In operation, the emitter portion generates a beam of IR light. The beam of light is directed towards the inner wall of the ice dispensing chute 32 opposite to the retroreflective sensor. In the absence of dispensed ice pieces, the beam of IR light is reflected by the ice dispensing chute 32 and received by the receiver portion. When an ice piece is dispensed, the ice piece will interrupt the beam of IR light. Thus, the control system can detect if an ice piece has been dispensed.

In an alternative embodiment, the sensing device 90 may be mounted on the inner wall of the ice crushing housing 51 and detect whether or not an ice piece is present in the metering device 42. In this embodiment, the emitter 92*a* may be mounted on the inner wall of the ice crushing housing 51 while the receiver 92*b* may be mounted in the opening of the metering device 42 so that when the metering device 42 rotates, the receiver 92*b* is positioned opposite to the emitter 92*a*. The emitter 92*a* directs light towards the receiver 92*b*. The beam of light is interrupted when an ice piece is present in the opening of the metering device 42. Thus, if the receiver 92*b* senses IR light from the emitter 92*a*, this indicates that the ice dispensing system will not release an ice piece. The control system can then send a signal to dispense another piece of ice.

Figure 9D:
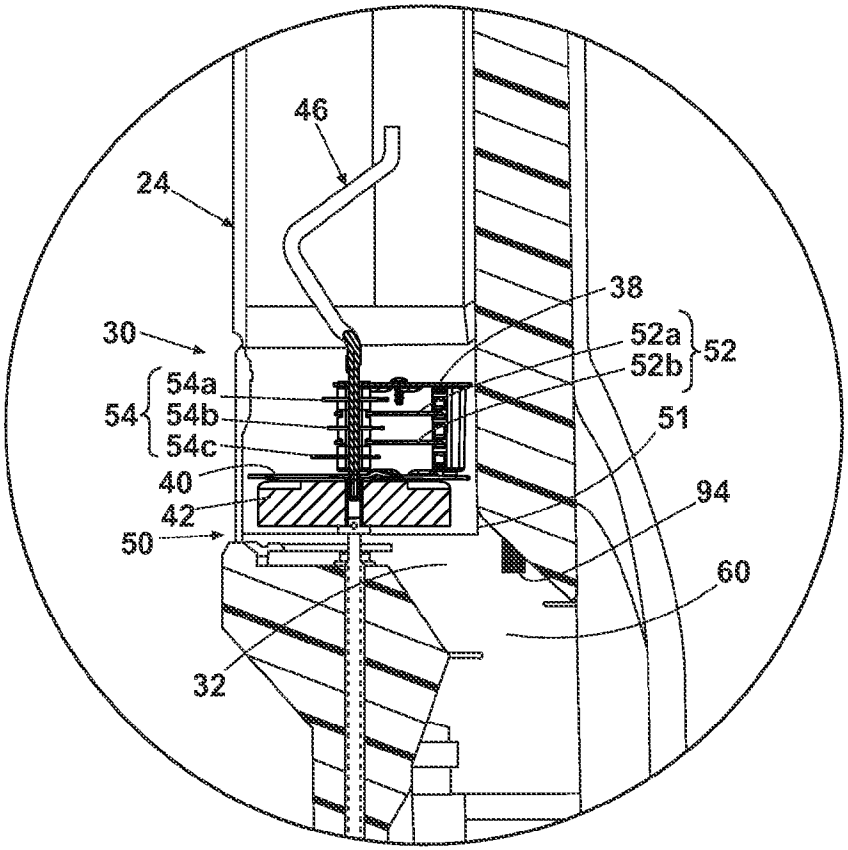
FIG. 9*d* is a fragmentary, side sectional view of the ice dispensing system illustrating an embodiment of a sensing system of the present invention.
Figure 9C:
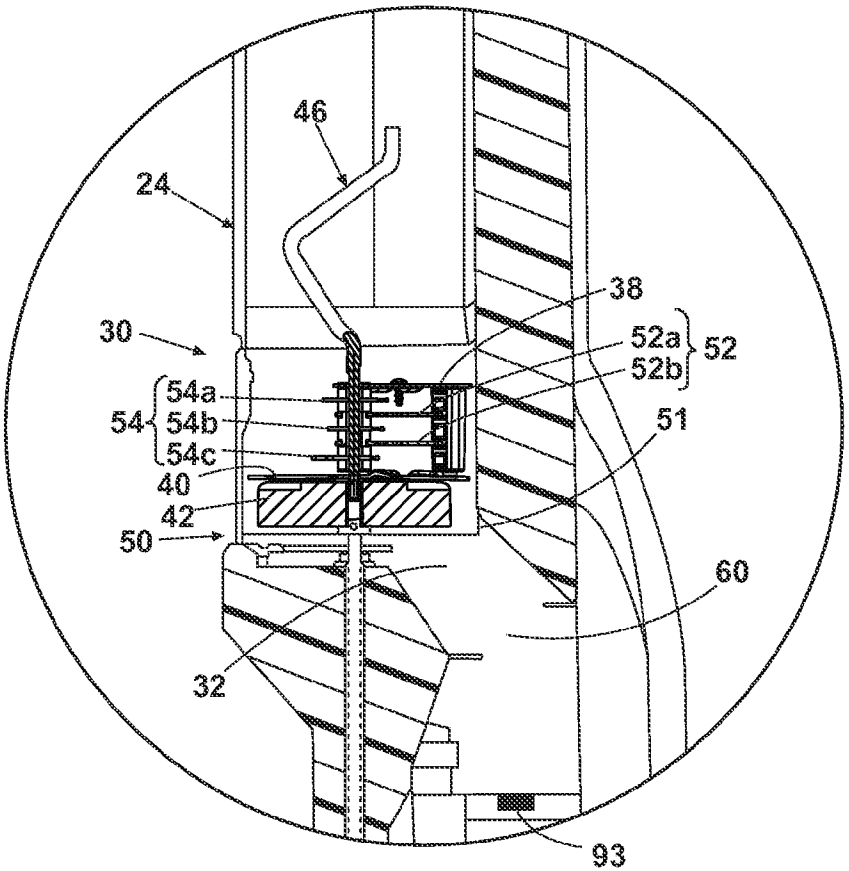
FIG. 9*c* is a fragmentary, side sectional view of the ice dispensing system illustrating an embodiment of a sensing system of the present invention.

Referring to FIG. 9*c*, the sensing device 90 may comprise a weight sensor 93 mounted in the ice service area 60, below where a user would place a container to receive ice. The number of ice pieces is counted by measuring a change in pressure when an ice piece is dispensed. As ice pieces are dispensed into the container, the weight of the ice causes an instantaneous change in pressure on the container. The weight sensor 93 detects the change in pressure. Thus, if the weight sensor 93 does not detect a change in pressure, this indicates that the ice dispensing system 30 has not dispensed an ice piece. The control system can then send a signal to dispense another piece of ice. Alternatively, the weight sensor 93 may be located immediately below the metering device 42 to detect an ice piece in the opening of the metering device 42.

Referring to FIG. 9*d*, the sensing device 90 may comprise an ultrasonic sensor 94. In this case, a user would request a level of ice, such as low, medium, or high, to be dispensed rather than a number of ice pieces. The ultrasonic sensor 94 detects the level of ice pieces dispensed by emitting ultrasonic waves and calculating the time between sending a wave and receiving the reflected wave. The time corresponds to a distance between the ultrasonic sensor and the top of the ice. Thus, the level of ice in the container can be determined. The ice dispensing system 30 would continue to dispense ice pieces until the desired level is met, as requested by a user. The ultrasonic sensor 94 may be mounted on one side of the ice dispensing chute 32 so that it is above where a user would place a container.

Referring again to FIGS. 5, 6, and 7, in another embodiment of the invention, the control system detects partial ice pieces dispensed. In operation, when crushed ice pieces are requested by a user, ice pieces are crushed by the ice crushing system 50 before moving into the opening of the metering device 42. A microprocessor samples the current of the agitator motor at repeated time intervals. When ice pieces are being crushed by the ice crushing system 50, the current drawn by the agitator motor will be higher than during normal agitator operation. Thus, the control system can compare the agitator motor current samples to a preset threshold value to determine whether or not ice pieces are being crushed. If the agitator motor current sample exceeds the threshold value, ice pieces are being crushed and the control system accordingly increments a counter. Thus, the number of crushed ice pieces can be determined and the ice dispensing system 30 continues to dispense crushed ice pieces until the desired level is met. The control system may be configured to disregard current samples during agitator motor startup. Additionally, the control system may be configured to disregard current samples for a preset period of time following the incrementing of the counter. While the above embodiment has been described using crushed ice, it can be readily understood that other forms of partial ice pieces, such as shaved ice pieces, could also be used and the invention would still achieve the desired result.

Figure 10:
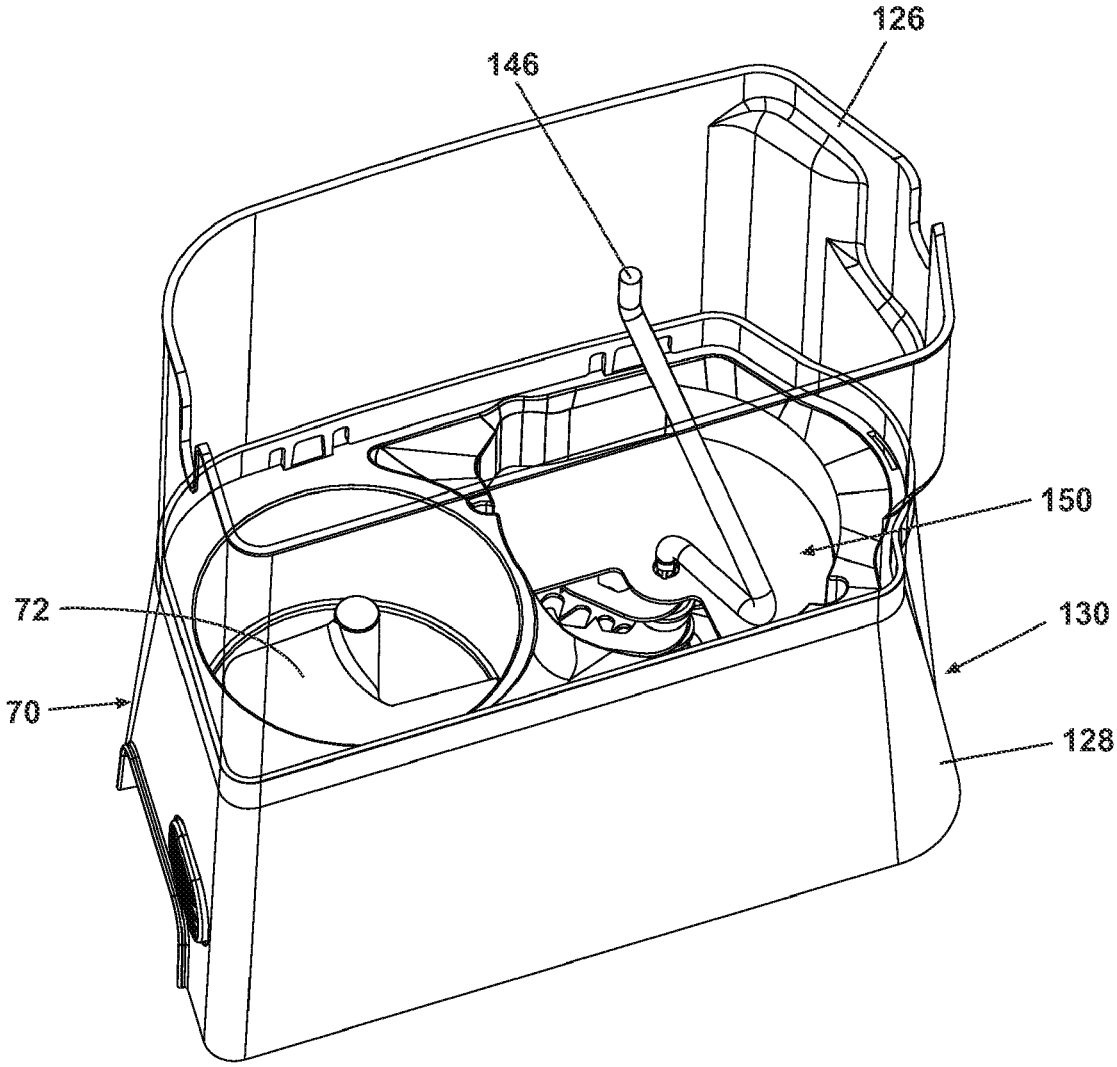
FIG. 10 is an enlarged perspective view of the top of the ice storage bin of the ice dispensing system according to a second embodiment of the present invention.

FIG. 10 discloses an alternative embodiment of the ice dispensing system 130. In this embodiment, the bottom ice bin member 128 further comprises an ice shaving system 70. The ice shaving system 70 is positioned adjacent to the ice crushing system 150 and functions to shave ice pieces to be dispensed. The ice dispensing system 130 comprises the same components as the first embodiment. In operation, an agitator 146 is rotated to move ice pieces into the ice dispensing system 130. Ice pieces may either be crushed by an ice crushing system 150 or uncrushed and separated by the metering device. Crushed ice pieces or uncrushed individual ice pieces are then dispensed through the ice dispensing chute. A shaved ice agitator 72 is disposed within the ice shaving system 70. When the shaved ice agitator 72 rotates, ice pieces are moved into the ice shaving system 70. The ice shaving system 70 typically does not include a metering device. Alternatively, the metering device 42 could be provided solely in the ice shaving system 70. Thus, in this embodiment, shaved ice pieces, crushed ice pieces, or individual metered ice pieces may be dispensed. It can be readily understood that the number of systems disposed within the bottom ice bin member 128 and the type of system could be changed without altering the function of the invention. For example, the bottom ice bin member 128 may comprise a single ice shaving system 70, a single ice crushing system 150, or multiple ice modification systems and still achieve the desired result.

While the present invention has been described with reference to the above described embodiments, those of skill in the art will recognize that changes may be made thereto without departing from the scope of the invention as set forth in the appended claims.

We claim:

1. An ice dispenser apparatus comprising:

an ice storage bin for storing ice pieces;

a metering device coupled to the ice storage bin and selectively dispensing individual ice pieces from the ice storage bin; and a sensing device detecting individual ice pieces dispensed from the metering device, wherein the metering device and the sensing device enable the dispensing of a desired number of ice pieces; and wherein the metering device comprises:

a cylindrical hub having an opening in the center; and a round disc surrounding said cylindrical hub with at least one opening along the perimeter.

2. The ice dispenser of claim 1, wherein the ice pieces are crescent shaped.

3. The metering device of claim 1, wherein the disc has two openings and the surfaces adjacent to the openings are sloped downwardly towards the openings.

4. The ice dispenser of claim 1, wherein the sensing device does not come in contact with ice pieces.

5. The ice dispenser of claim 4, wherein the sensing device comprises at least one of the following: an optical sensor, capacitive sensor, ultrasonic sensor, and weight sensor.

6. The ice dispenser of claim 1, wherein the sensing device comprises at least one vibration sensor.

7. An ice dispenser apparatus comprising:

an ice storage bin for storing ice pieces;

a metering device coupled to the ice storage bin and selectively dispensing individual ice pieces from the ice storage bin;

a sensing device detecting individual ice pieces dispensed from the metering device, wherein the metering device and the sensing device enable the counting of the number of ice pieces dispensed; and a control system configured to receive a user input of the desired number of ice pieces to define an ice piece count for dispensing and an output of the a sensing device regarding the number of the dispensed ice pieces, wherein the control system uses the output of the sensing device to count the number of ice pieces that are dispensed and permits dispensing of the individual ice pieces until the number of pieces dispensed satisfies the ice piece count.

8. The ice dispenser of claim 7, wherein the ice pieces are crescent shaped.

9. The ice dispenser of claim 7, wherein the sensing device does not come in contact with ice pieces.

10. The ice dispenser of claim 9, wherein the sensing device comprises at least one of the following: an optical sensor, capacitive sensor, ultrasonic sensor, and weight sensor.

11. The ice dispenser of claim 7, wherein the sensing device comprises at least one vibration sensor.

12. A refrigerator having an ice dispenser apparatus comprising:

an ice storage bin for storing ice pieces;

a metering device coupled to the ice storage bin and selectively dispensing individual ice pieces from the ice storage bin;

a sensing device for detecting individual ice pieces dispensed from the metering device; and a control system configured to receive a user input of the desired number of ice pieces to define an ice piece count for dispensing and an output of the a sensing device to count the number of ice pieces that are dispensed;

wherein the control system permits dispensing of the individual ice pieces until the count of the number of ice pieces dispensed satisfies the ice piece count.

13. The refrigerator of claim 12, wherein the ice dispenser apparatus is mounted to a refrigerator closure member or door.

14. The refrigerator of claim 12, further comprising a second receptacle wherein at least one of the receptacles leads to a metering device.

* * * * *